US005749970A

United States Patent [19]

Fukuta et al.

[11] Patent Number: 5,749,970

[45] Date of Patent: May 12, 1998

[54] APPARATUS FOR COATING OUTER PERIPHERAL SURFACE OF COLUMNAR STRUCTURAL BODY WITH A COATING MATERIAL

[75] Inventors: Ken Fukuta, Ama-Gun; Toshihiro Sano; Tsutomu Hirota, both of Gifu, all of Japan

[73] Assignee: NGK Insulators, Ltd., Japan

[21] Appl. No.: 622,012

[22] Filed: Mar. 26, 1996

[30] Foreign Application Priority Data

Mar. 30, 1995 [JP] Japan ..... 7-073204

[51] Int. Cl.[6] ..... B05B 13/04; B05C 5/00; B05C 11/02

[52] U.S. Cl. ..... 118/320; 118/305; 118/110

[58] Field of Search ..... 118/320, DIG. 3, 118/110, 305, 306, 318

[56] References Cited

U.S. PATENT DOCUMENTS

| | | | |
|---|---|---|---|
| 4,397,893 | 8/1983 | Bottoms | 427/319 |
| 4,809,640 | 3/1989 | Pilley et al. | 118/257 |
| 4,938,275 | 7/1990 | Leatham | 164/46 |
| 5,357,857 | 10/1994 | Zimmer | 101/120 |

FOREIGN PATENT DOCUMENTS

| | | | |
|---|---|---|---|
| 307527 | 9/1987 | France | 118/203 |
| 3-275309 | 12/1991 | Japan . | |
| 5-261716 | 10/1993 | Japan . | |

*Primary Examiner*—Donald E. Czaja
*Assistant Examiner*—Jacqueline A. Ruller
*Attorney, Agent, or Firm*—Parkhurst & Wendel

[57] ABSTRACT

Apparatus for coating an outer periphery of a columnar structural body comprising (a)a holder for supporting a columnar structural body; (b) a coater for coating the outer periphery of the columnar structural body with a coating material, (c) a feeder for feeding the coating material to the coater; (d) a driving unit for rotating at least one of the columnar structural body and the coater relative to each other around an axis of the holder; and (e) a doctor blade spaced from the outer periphery of the columnar structural body by a given distance for uniformly spreading a coating material applied around the outer periphery of the columnar structural body.

15 Claims, 6 Drawing Sheets

APPARATUS FOR COATING OUTER PERIPHERAL SURFACE OF COLUMNAR STRUCTURAL BODY WITH A COATING MATERIAL

BACKGROUND OF THE INVENTION (1) Field of the Invention

The present invention relates to an apparatus for coating the outer peripheral surface of a columnar structural body with a coating material.

(2) Related Art Statement

Conventionally, the outer peripheral surface of a columnar structural body has been conventionally manually coated by workers using, for example, spatulae. However, if the workers must manually apply the coating in this manner, they are required to have high skill and the coating operation requires a large degree of manual labor and takes a long time. Therefore, if a number of coated columnar structural products are to be mass-produced, the coating efficiency is low. Thus, the above manual coating step obstructs mass-production.

NGK Insulators, Ltd. proposed a process for the production of ceramic honeycomb structural bodies in Japanese patent application No. 2-75602 (JP-A-3 275309). According to this application, an outer wall portion is formed by preliminarily removing an outer peripheral portion of a honeycomb structural body obtained by molding, cutting through working and firing and coating the outer peripheral wall of the resultant honeycomb structural body with a coating material. By so doing, even if deformed cells are present at the outer peripheral portion of the honeycomb structural body, a final honeycomb structural product having sufficient strength can be obtained. This process is for the production of ceramic honeycomb structural products.

Under the consideration that if the above coating step is automatized or mechanized, the above production process could be more effectively performed with the number of working steps being reduced, NGK Insulators, Ltd. has also proposed an apparatus for coating the outer periphery of the ceramic honeycomb structural body in Japanese patent application No. 4-64768 (JP-A-5 261716) for the above purpose. However, it was found that the coating material might leak onto end faces of the honeycomb structural body, it might be difficult to remove the coated product from the apparatus, and the apparatus might be contaminated with the coating material. Therefore, it was found that this apparatus might suffer trouble in terms of product quality and workability.

SUMMARY OF THE INVENTION

The present invention has been accomplished in view of the above problems, and is aimed at the provision of an apparatus for appropriately coating the outer peripheral surface of the columnar structural body, which can enable the automatic, mechanized production of the above coated honeycomb structural bodies with a reduced number of steps.

The apparatus for coating the outer peripheral surface of a columnar structural body includes (a) a holder for supporting a columnar structural body; (b) a coater for coating the outer periphery of the columnar structural body with a coating material; (c) a feeder for feeding the coating material to the coater; (d) a driving unit for rotating at least one of the columnar structural body and the coater relative to each other around an axis of the holder; and (e) a doctor blade spaced from the outer periphery of the columnar structural body by a given distance for uniformly spreading a coating material applied around the outer periphery of the columnar structural body.

According to the coating apparatus of the present invention, the coating material is applied to the outer peripheral surface of the columnar structural body and the uneven coating material coated onto this outer peripheral surface of the columnar structural body is made smooth in a thickness corresponding to said given distance by the doctor blade, while at least one of the columnar structural body and the coater is being rotated relative to each other around an axis of the holder.

According to the coating apparatus of the present invention, the coating material can be automatically coated onto the outer peripheral surface of the columnar structural body passing the coating section. By so doing, the coating material-applying work which has been manually effected can be automatically mechanized so that manual labor can be saved, and the coated columnar structural body can be produced with a high precision.

These and other objects, features and advantages of the invention will be appreciated upon reading of the following description of the invention when taken in conjunction with the attached drawings, with the understanding that some modifications, variations and changes could easily be made by the skilled person in the art.

BRIEF DESCRIPTION OF THE DRAWINGS

For a better understanding of the invention, reference is made to the attached drawings, wherein.

DETAILED DESCRIPTION OF THE INVENTION

Figure 1:
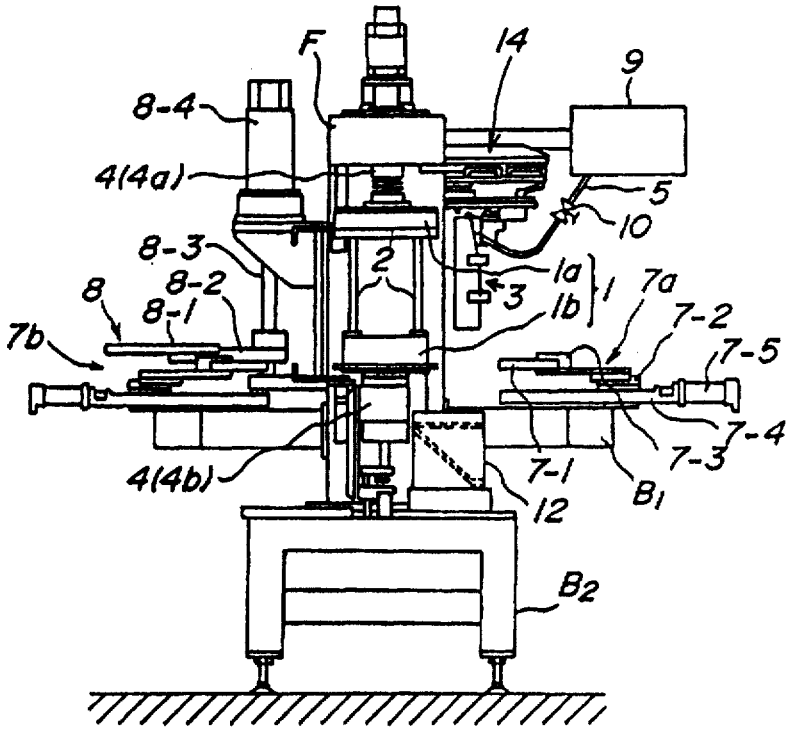
FIG. 1 is a front view of an embodiment of the apparatus for coating the outer periphery of a columnar structural body according to the present invention.
Figure 2:
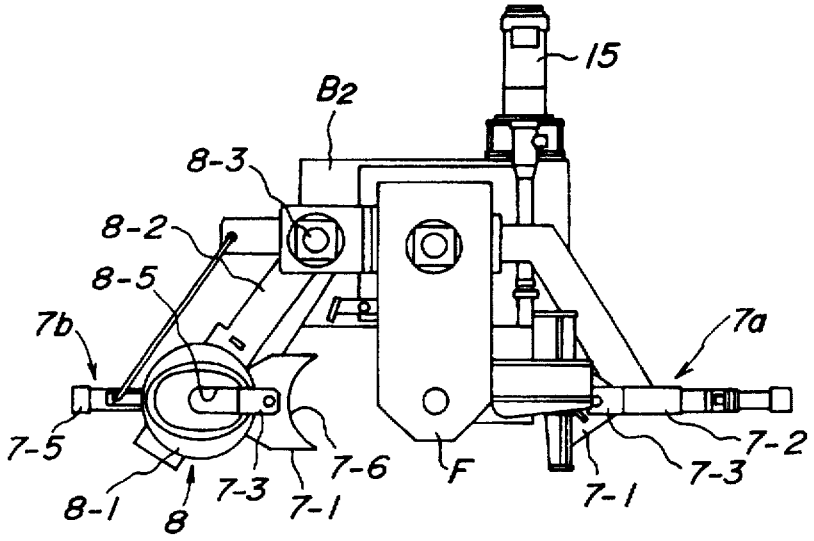
FIG. 2 is a plane view of the apparatus for coating the outer periphery of a columnar structural body according to the present invention shown in FIG. 1.

The term "columnar structural body" used in this application may mean an object having a curved outer peripheral configuration extending substantially in parallel with the axis of the holder. Such an object may typically have a circular or elliptical sectional shape when viewed as a plane cut in a direction orthogonal to the axis of the holder. For example, the columnar structural body may be a honeycomb structural body of which the outer peripheral portion is ground away to remove deformed outer peripheral channel portions. The columnar structural body includes columnar structural bodies having a radially outwardly swelled or radially inwardly concaved peripheral wall face, and columnar structural bodies having a frustum shape.

First, preferred embodiments of the apparatus for coating the outer periphery of the columnar structural body according to the present invention will be explained below. The following preferred embodiments may be employed in any combinations so long as such combinations produce no contradictory result.

(1) A driving mechanism is provided for moving the doctor blade along the outer peripheral surface of the columnar structural body. In this case, the coating material layer can be formed around the outer peripheral surface of the columnar structural body by making smooth the uneven coating material applied onto the outer peripheral surface through positively moving the doctor blade along the outer peripheral surface of the columnar structural body.

(2) An aligning mechanism is provided for aligning a rotary axis of the columnar structural body supported by holder with that of the holder. Since the rotary axis of the columnar structural body can be assuredly aligned with that of the holder, the coating material can be assuredly applied onto the outer peripheral surface of the columnar structural body and the uneven coated material can be assuredly made smooth by the doctor blade.

(3) A transporter is for feeding the columnar structural body to the holder from outside the apparatus. Since the columnar structural body is fed to the holder from the outside by the transporter, the steps of feeding and coating the columnar structural body can be facilitated. Further, the coated columnar structural body can also be transferred from the holder to a drying site by the transporter without manual labor.

(4) The holder comprises first and second pallets at least one of which is movable in parallel to said axis of the holder, and the columnar structural body is to be sandwiched between the first and second pallets. Since the columnar structural body is held for coating in the state that the structural body is sandwiched between the first and second pallets, the columnar structural body can be assuredly held by the holder irrespective of the shape of the outer peripheral surface of the columnar structural body. If the columnar structural body can be stably held by only one pallet, the holder may include such a pallet only. The term "pallet" used in this application means a tool adapted to support or press an end face of the columnar structural body, and such a tool has, for example, an overall planar shape having a circular or elliptical shape and a substantially flat supporting or pressing surface. The pallet has preferably a shape similar to but smaller than that of the outer periphery of the columnar structural body by a given amount equal to the coating material to be coated around the outer peripheral surface of the columnar structural body. The pallet is made of such a material in such a thickness as to allow the doctor blade to contact and move along the outer peripheral surface of the pallet. The pallet preferably has such a sufficient flatness as to cause no backlash of the columnar structural body placed on the pallet or held between the upper and lower pallets. Further, the upper and lower pallets preferably have opposed flat surfaces sufficiently parallel to each other. A rotary driving shaft is fitted to a rotationally central portion of each of the pallets.

(5) The first and second pallets are vertically arranged and opposed to each other. In this case, since the columnar structural body can stand on the lower pallet, the holder can be structurally simplified.

(6) The first and second pallets have substantially the same outer peripheral shape. In this case, since the doctor blade can follow the outer peripheral surfaces of the first and second pallets, rigidity of the doctor blade may be reduced as compared with a case where the doctor blade follows the outer peripheral surface of only one pallet, even if the columnar structural body is long and the viscosity of the coating material is high.

(7) A separator is provided for keeping substantially constant the distance between the doctor blade and the outer periphery of the columnar structural body. Such a separator may follow an outer periphery of at least one of the first and second pallets during the relative rotation of the columnar structural body and the coater. Alternatively, the separator may be constituted such that an end portion of the doctor blade is contacted with the outer peripheral surface of at least one of the first and second pallets. In both the cases, the coated material layer can be assuredly formed around the outer peripheral surface of the columnar structural body in a desired constant thickness. In the latter case, if the doctor blade has a radially inwardly straight end and when the end portion of the doctor blade follows the outer peripheral surface of at least one of the first and second pallets for making smooth the coated material upon the columnar structural body, the coated columnar structural body has a cross sectional shape equal to the shape of the outer peripheral surface of said at least one of the first and second pallets. If the doctor blade has a stepped longitudinal end portion and this stepped end portion is contacted with the outer peripheral surface of at least one of the first and second pallets, the coated columnar structural body has a cross sectional shape similar but smaller or greater than the shape of the outer peripheral surface of said at least one of the first and second pallets by a given dimension. Therefore, if the columnar structural body having a circular cross section is to be coated, the outer peripheral configuration of the pallet may be of a circular shape. If the columnar structural body having an elliptical cross section is to be coated, the outer peripheral configuration of the pallet may be of an elliptical shape.

(8) The doctor blade has an angle of 30°–60° relative to a tangential line of the columnar structural body at a point facing the radially inner end of the doctor blade. If the angle is less than 30°, a force of the doctor blade to remove excess coating material may be smaller so that the outer peripheral shape of the coated columnar structural body may be smaller than a target dimension. On the other hand, if the angle is more than 60°, a force of the doctor blade to press down the coating material upon the outer peripheral surface of the columnar structural body may be smaller so that it may be difficult to uniformly coat the coating material upon the outer peripheral surface of the columnar structural body.

(9) First and second follower rollers are contacted with the outer peripheral surface of the second pallet while the follower rollers are spaced from each other by a given distance and outer peripheral surfaces thereof are in parallel to the longitudinal direction of the columnar structural body, the doctor blade forms a given angle relative to a segment connecting centers of the first and second follower rollers, and the doctor blade follows the outer peripheral surface of the second pallet while being moved to-and-fro relative to the outer peripheral surface of the second pallet. In this case, if the columnar structural body has a cross sectional outer peripheral shape smaller than that of the second pallet, the coating material can be uniformly applied around the outer peripheral surface of the columnar structural body. In this embodiment, it may be that two follower rollers and the doctor blade are arranged at a single base plate, and the base plate is rotatable around a center between the centers of the two rollers. The angle between the doctor blade and a tangential line of the peripheral surface of the columnar structural body at a point facing the doctor blade becomes constant. Even if the columnar structural body has an outer peripheral shape having a varying curvature, such as an elliptical outer peripheral shape, the doctor blade can be moved to-and-fro relative to the second pallet and follow such a varying curvature-possessing outer peripheral surface of the pallet, that is, changes in radial length from the rotary axis of the pallet. An urging means such as a spring is provided for pressing the doctor blade onto the outer periphery of the pallet.

(10) In addition to the above embodiment (9), third and fourth follower rollers are contacted with the outer peripheral surface of the first pallet while the third and fourth follower rollers are spaced from each other by a given distance, the first follower roller is aligned with the third follower roller, and the second follower roller is aligned with the fourth follower roller. By so adding, as compared with the embodiment (9) in which the first and second follower rollers only are employed, the rigidity of the doctor blade may be reduced.

(11) The doctor blade is made of a SUS stainless steel or a wear resistant ceramic material. In this case, durability of the doctor blade can be improved. As the wear resistance ceramic material, $Si_3N_4$, PSZ (partially stabilized zirconia) and $Al_2O_3$ may be recited by way of example.

(12) The first pallet and/or the second pallet is made of made of a SUS stainless steel or a wear resistant ceramic material. In this case, durability of the pallet can be improved. As the wear resistance ceramic material, $Si_3N_4$, PSZ (partially stabilized zirconia) and $Al_2O_3$ may be recited by way of example.

(13) A resilient sheet through which the coating material will not permeate is provided at each of the opposed surfaces of the first and second pallets. By so doing, the coating material can be prevented from contacting the surface of the pallet through the resilient sheet, and consequently the quality of the coated columnar structural body can be maintained high and workability can also be improved.

In the following, a specific embodiment of the apparatus for coating the outer peripheral surface of the columnar structural body according to the present invention will be explained with reference to the attached drawings.

FIG. 1 is a front view of this embodiment. In this figure, a holder 1 for supporting the columnar structural body is constituted by a pair of upper and lower pallets 1*a*, 1*b* at least one of which is movable in parallel to the axis of the holder along a pair of guide rails 2, 2 so that the columnar structural body may be sandwiched between the upper and lower pallets 1*a*, 1*b*. In this embodiment, the lower pallet 1*b* is moved up so as to sandwich the columnar structural body between the upper and lower pallets 1*l*a, 1*b*.

A reference numeral 3 denotes a coater having a longitudinal coating material discharge opening 3*a* (See FIGS. 5*b–c*) extending vertically near and along the outer peripheral surface of the structural body sandwiched between the upper and lower pallets 1*a*, 1*b*. This coater is to coat the outer peripheral surface of the columnar structural body with a coating material in the state that the columnar structural body is held between the upper and lower pallets 1*a*, 1*b* under rotation. In this embodiment, the outer peripheral shape of the upper parellet 1*a* is the same as that of the lower pallet 1*b*. At least the outer peripheral portion of each of the upper and lower pallets is made of a pressureless sintered $Si_3N_4$ ceramic material, and a resilient coating material non-permeable cloth is positioned on each of the opposed faces of the upper and lower pallets.

A driving mechanism 4 rotates the columnar structural body (including the holder) relative to the coater around the axis of the holder. This driving mechanism includes a pair of upper and lower driving units 4*a* and 4*b* connected to the respective upper and lower pallets 1*a*, 1*b* so that the upper and lower pallets 1*a*, 1*b* may be rotated synchronizingly around the rotary axis of the holder. The driving units may be servo motors, and the rotating speed or the number of revolutions of the upper and lower pallets 1*a*, 1*b* can be controlled by the above synchronized servo motors via timing belts not shown.

A reference numeral 5 denotes a feeder for feeding the coating material to the coater. A doctor blade 30 is provided downstream of the opening 3*a* of the feeder 3 as viewed in a rotating direction in which the columnar structural body is rotated relative to the coater. The doctor blade 30 is preferably inclined downstream such that the doctor blade forms an angle of 30° to 60° (In this embodiment, the angle is 45°, which is the most preferable) relative to a tangential line at the outer peripheral surface of the columnar structural body at a point where the tip end of the doctor blade faces the outer peripheral surface of the columnar structural body.

The upper inward longitudinal end portion of the doctor blade 30 may follow the outer peripheral surface of the upper pallet la under the rotation of the holder. By so doing, if the outer peripheral shape of the columnar structural body is similar to but smaller than that of the upper pallet 1*a*, the clearance between the outer peripheral surface of the columnar structural body and the radially inner end of the doctor blade 30 can be easily kept constant. The doctor blade 30 may be made of partially stabilized zirconia.

An aligning mechanism 7 is provided to align the rotary axis of the columnar structural body supported by the holder 1 with that of the rotary axis of the holder. This aligning mechanism 7 is constituted by a pair of right and left aligning units 7*a*, 7*b*. Each aligning unit includes an aligning blade 7-1 swingably supported onto an intermediate member 7-2 by a connector 7-3. The intermediate member 7-2 is guided along a rail 7-4 by means of a cylinder mechanism 7-5 so that the aligning blade 7-1 may move to-and-fro relative to the holder 1. The aligning blade 7-1 has an inner recess 7-6 having a shape meeting the outer periphery of the columnar structural body.

A transporter 8 is provided to feed the columnar structural body to the holder 1. This transporter 8 includes a table 8-1 on which the columnar structural body is to be placed, a swing arm 8-2, a support shaft 8-3 and a swinging motor 8-4. The table 8-1 is connected to the support shaft 8-3 via the swing arm 8-2, and is swung by the swinging motor 8-4 via the support shaft 8-3 and the swing arm 8-2.

Figure 3:
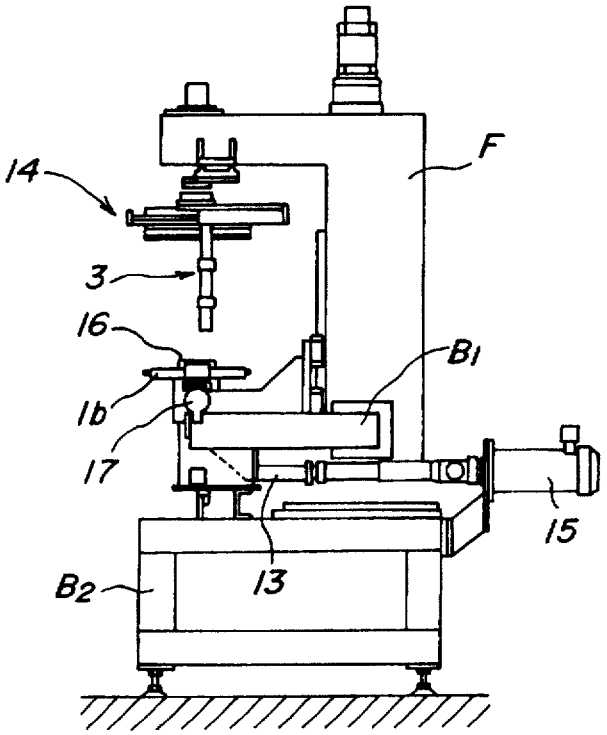
FIG. 3 is a side view of the apparatus for coating the outer periphery of a columnar structural body according to the present invention shown in FIG. 1.

In FIG. 1, a reference numeral 9 denotes a coating material tank to which the feeder 5 is connected via a feed valve 10. A reference numeral 12 denotes a receiving vessel into which excess coating material is peeled down from the coated columnar structural body by means of the doctor blade 30. In FIG. 3, an excess coating material discharge line 13 is connected to a discharge opening at a side bottom portion of the receiving vessel 12.

In FIGS. 1 and 3, a reference numeral 14 denotes a controller for adjusting the location of the feeder 3 and/or the doctor blade 30 relative to the columnar structural body. For example, depending upon the size and the outer configuration of the columnar structural body, the feeder 3 and/or the doctor blade 30 is moved up or down, or depending upon the rotated angle, etc. the feeder and/or the doctor blade is moved more inwardly or more outwardly relative to the rotating axis of the holder so that the distance between the doctor blade and the outer peripheral surface of the columnar structural body may be always kept substantially constant. In such a case, necessary data of the size and the outer configuration of the columnar structural body, and its rotated angle, etc. are preliminarily inputted to a CPU of the controller, and the controlling is effected based on the thus preliminarily inputted data. The above controller will be easily contrived based on the conventional knowledge, and therefore details of the same will not be discussed.

A reference numeral 15 denotes a motor mode pump for transferring the excess coating material removed from the columnar structural body by the doctor blade and received by the receiving tank. This pump is connected to the excess coating material discharge line 13.

A push-up plate 16 is fitted in a center through-hole of the lower pallet **1*b*, and is moved upwardly from the lower pallet 1*b* and sunk into the lower pallet by operating a cam 17 located under the push-up plate 16. After the columnar structural body put on the table 8-1 of the transporter 8 is positioned in place above the lower pallet 1*b* and is then pushed up by moving up the push-up plate 16 through operating the cam 17, the table 8-1 is retracted to its original waiting position while the push-up rod passes a notch 8-5, and finally putting the columnar structural body onto the lower pallet 1*b* by sinking the push-rod 16 into the lower pallet 1*b***.

In the following, the operation of the above embodiment will be briefly explained.

First, the columnar structural body such as a honeycomb structural body of which the outer peripheral portion involving deformed channel portions are removed is put on the table 8-1 of the transporter 8, and the table 8-1 is swung to above the lower pallet **1*b*. Then, as mentioned above, the honeycomb structural body is pushed up by means of the push-up plate 16 through the notch 8-5 of the table 8-1, and the table 8-1 is moved to its original position. Thereafter, the push-up plate 16 is sunk into the lower pallet 1*b* to put the honeycomb structural body on the lower pallet 1*b*. The rotary axis of the honeycomb structural body is aligned with that of the holder, i.e., the lower pallet 1*b*, by means of the aligning mechanism 7 (7*a*, 7*b*). Next, the honeycomb structural body put on the lower pallet 1*b* is moved up by raising the lower pallet until the upper face of the honeycomb structural body contacts the upper pallet 1*a*. Thereby, the honeycomb structural body is sandwiched between the upper pallet 1*a* and the lower pallet 1*b***.

On the other hand, a coating material having a viscosity of such as 170 poises is fed into the receiving tank 9. In this case, the upper and lower end portions of the doctor plate 30 are contacted with the upper pallet **1*b* and the lower pallet 1*b*, respectively. The coating material is fed into the feeder 3 through the coating material feed line 5 and the valve 10 by actuating a slurry pump not shown. The coating material is applied to the outer peripheral surface of the honeycomb structural body through the discharge opening 3*a* of the feeder 3, and the coating material applied onto the outer peripheral surface of the honeycomb structural body is made smooth, by means of the doctor blade 30, in a given thickness corresponding to the clearance between the outer peripheral surface of the honeycomb structural body and the radially inner end of the doctor blade 30**.

In this case, the coating material is also led into opened channel portions at the outer peripheral portion of the honeycomb structural body. The diameter of the outer peripheral surface of each of the upper and lower pallets **1*a*, 1*b* is the same as that of the outer peripheral surface of a final coated honeycomb structural body. The outer peripheral surface of the ground honeycomb structural body is set smaller than that of the outer peripheral surface of the final coated honeycomb structural body, that is, than that of the outer peripheral surface of each of the upper and lower pallets 1*a*, 1*b*, by 0.2 mm to 2.0 mm. In the above, the number of revolutions of each of the upper and lower pallets 1*a*, 1*b*** is set at 5 rpm for a first one turn and at 20 rpm for succeeding turns until the desired coated peripheral surface is formed.

After the coating, the rotation of the upper and lower pallets **1*a*, 1*b* is stopped, and the lower pallet 1*b* is moved down. Then the coated honeycomb structural body is pushed up from the lower pallet 1*b* by means of the push-up plate 16, and the honeycomb structurally body is manually moved up at its lower end face and carried to a drying section not shown. Alternatively, the pushed up coated honeycomb structural body is transferred to the table 8-1 of the transporter 8**, which carries the coated honeycomb structural body to the drying section.

Excess coating material peeled from the coated material layer around the honeycomb structural body by the smoothening step is received by the excess slurry receiving vessel 12 under the doctor blade 30, and then returned to the receiving tank 9 by a pump not shown.

Figure 4:
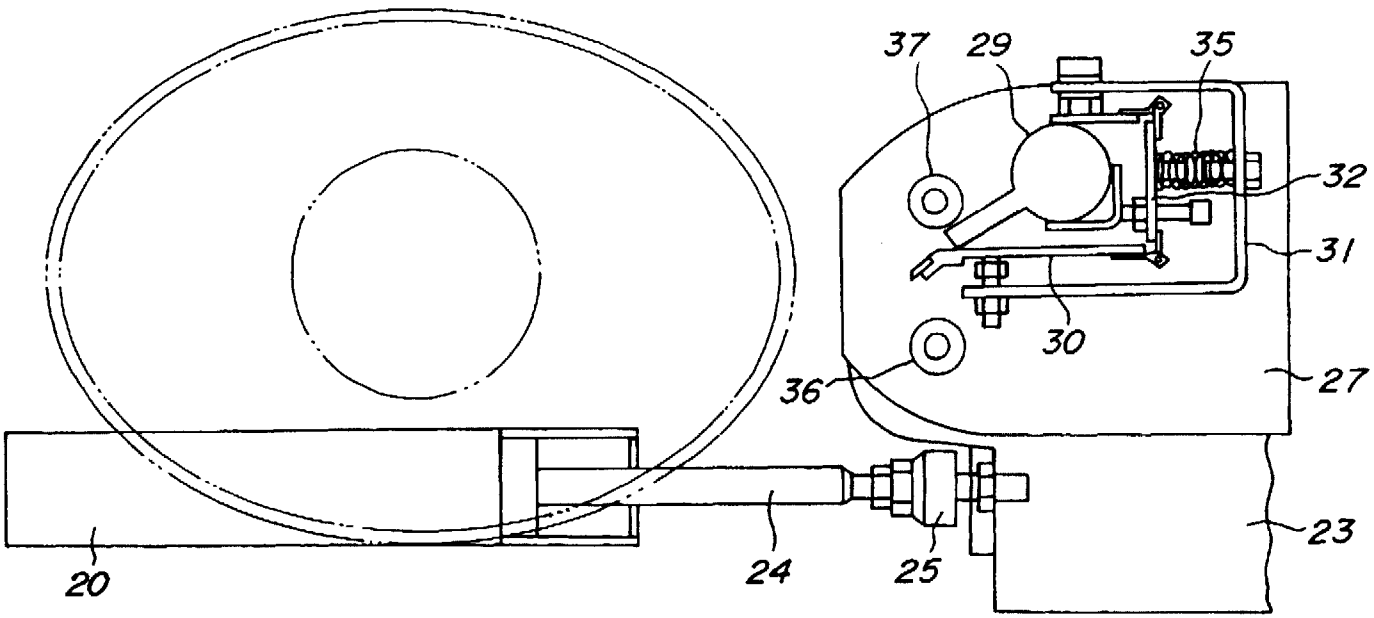
FIG. 4 is a bottom plane view for illustrating follower rollers and a doctor blade in relation to a columnar structural body.
Figure 5A:
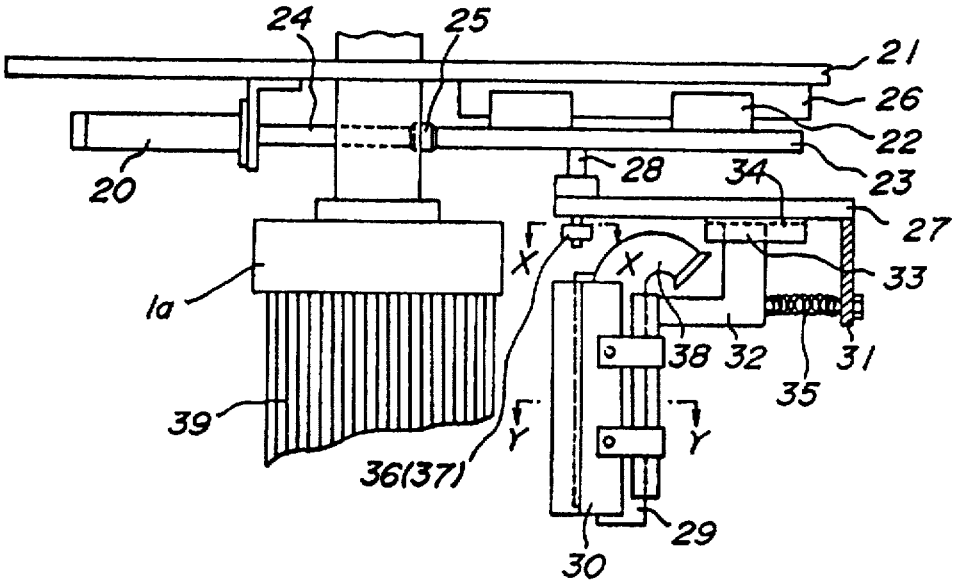
FIGS. 5(*a*) to 5(*c*) illustrate the follower rollers and the doctor blade in FIG. 4, FIG. 5(*a*) being a side view of the follower rollers and the doctor blade, and FIGS. 5(*b*) and 5(*c*) being schematic views for illustrating the coater and the blade as well as the follower rollers as viewed in directions X and Y.
Figure 5B:
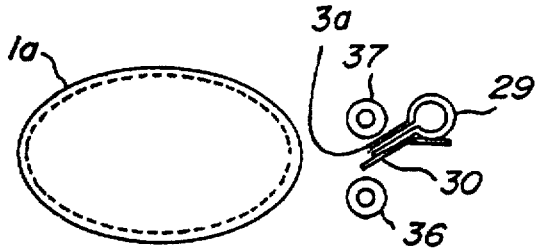
Figure 5C:
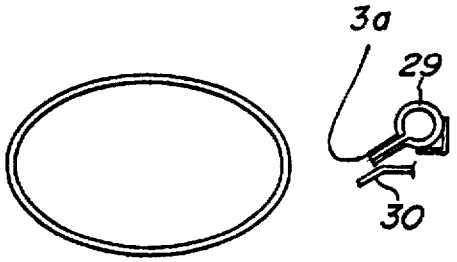
Figure 6A:
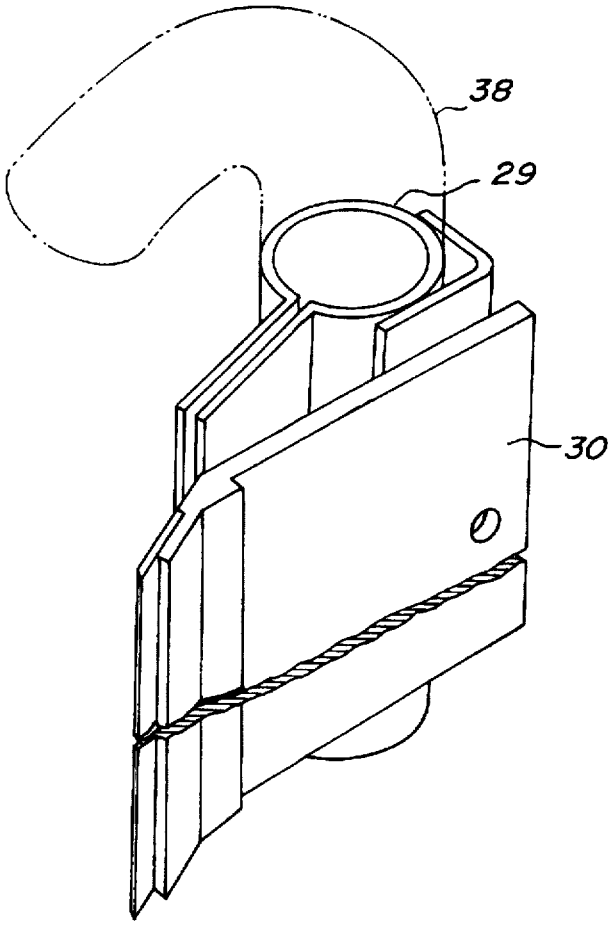
FIG. 6 (*a*) through FIG. 6(*c*) illustrate the coater and the doctor blade in FIGS. 4 and 5(*a*) to 5(*c*), FIGS. 6(*a*) to 6(*c*) being a perspective view, a top view and a side view of the coater and the doctor blade, respectively.
Figure 6B:
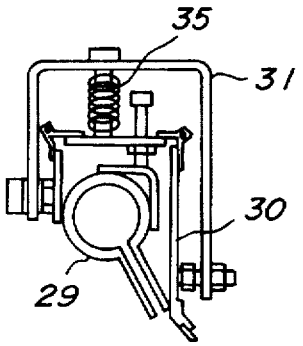
Figure 6C:
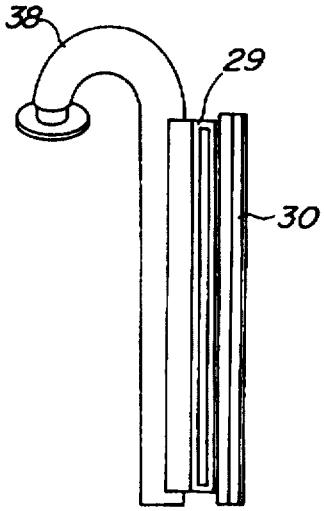

FIG. 4 is a bottom plane view for illustrating follower rollers and a doctor blade in relation to a columnar structural body. FIGS. 5(*a*) to 5(*c*) illustrate the follower rollers and the doctor blade in FIG. 4. FIG. 5(*a*) being a side view of the follower rollers and the doctor blade, and FIGS. 5(*b*) and 5(*c*) being schematic views for illustrating the coater and the blade as well as the follower rollers as viewed in directions X and Y. FIG. 6 (*a*) through FIG. 6(*c*) illustrate the coater and the doctor blade in FIGS. 4 and 5(*a*) to 5(*c*), FIGS. 6(*a*) to 6(*c*) being a perspective view, a top view and a side view of the coater and the doctor blade, respectively.

In FIGS. 4 and 5(*a*) to 5(*c*), a cylinder 20 is fixed to a ceiling plate 21 of the machine frame, and guide rollers 22 rotatably fixed to a base support plate 23 to which a rod 24 extending through the cylinder 20 is connected to the base support plate 23 via a joint 25. The guide rollers 22 are contacted with a guide plate 26 fixed to the ceiling plate 21. A base plate 27 is fixedly held by the base support plate 23 via a base shaft 28. The coater 29 and the doctor blade 30 are supported by an end support plate 31 via an L-shaped connecting plate 32. A guide roller 33 is rotatably fixed to an upper end of the connecting plate 32, and is contacted with a guide plate 34 fixed to the under face of the base plate 27. A reference numeral 35 denotes a spring fitted around a rod extending between the end support plate 31 and the connecting plate 32 and adapted for urging the coater 29 and the doctor blade 30 in the left direction of FIGS. 4 and **5*a***.

Reference numerals 36, 37 are follower rollers, and reference numerals 38 and 39 denote a feed pipe and a honeycomb structural body held between the upper and lower pallets, respectively.

In the above construction, the coater 29 and the doctor blade 30 are moved toward or apart from the holder (the upper pallet 1*a*) by actuating the cylinder 20. When the follower rollers 36, 37 as well as the doctor blade 30 are contacted with the outer peripheral surface of the upper pallet 1*a* and the holder is rotated in this state, the follower rollers 36, 37 smoothly follow the outer peripheral surface of the upper pallet 1*a* by the action of the spring and the guiding mechanism 33 and 34.

Figure 7:
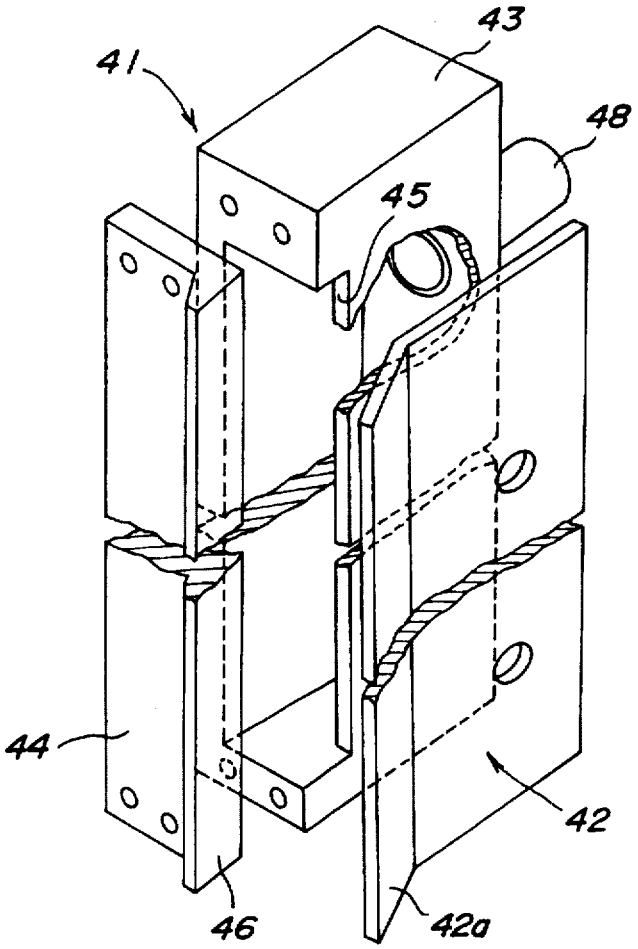
FIG. 7 is a perspective view for illustrating a coater and a doctor blade.

FIG. 7 shows a perspective view for illustrating a coater 41 and a doctor blade 42 in an another embodiment. The coater 41 includes a side face-opened box-shaped casing 43 and a side plate 44 fixed to the side face of the casing 43. A recess 45 is formed in a front plate near the open side of the casing 43, and a guide portion 46 is provided at an edge portion of the side plate 44 near the recess 45. A nozzle portion is formed by the recess 45 and guide portion 46. A feed pipe 48 is fixed to a side plate of the casing opposite to the side plate 44. The doctor blade 42 is fixed to the front plate of the casing, and a side portion 42 of the doctor blade 42 is bent in a front side at a given angle so that the coating material applied upon the outer periphery of the columnar structural body may be smoothened by the bent side portion of the doctor blade 42.

Examples 1 through 11

By using the above coating apparatus, four kinds of columnar and circular cross-sectional honeycomb structural bodies were produced by coating their outer peripheral surfaces with the coating material. Those four kinds of the honeycomb structural bodies were (1) the diameter: 165.1 mm and the length of 152.4 mm, (2) the diameter: 190.5 mm and the length of 177.8 mm, (3) the diameter: 241.3 mm and the length of 152.4 mm, (4) the diameter: 165.1 mm and the length of 152.4 mm.

In each of the honeycomb structural bodies, the thickness of each rib was 0.175 mm, and the density of cells was 400 cells/inch$^2$.

In each example (Examples 1 through 11), plural coated honeycomb structural bodies were produced, and the average outer diameter and the standard deviation were determined. Results are shown in Table 1. From the above results, it is seen that the final coated products could be obtained by using the coating apparatus of the present invention within their tolerance of the respectively specified outer diameters thereof.

On the other hand, each of the coated honeycomb structural bodies was obtained in about 4 minutes when the coating was manually effected (See Comparative Examples 1 to 11 given later), whereas each of the coated honeycomb structural bodies produced by using the coating apparatus according to the present invention could be obtained in about 50 seconds. Thus, it is seen that the coating apparatus greatly improved productivity.

TABLE 1

| | Shape | Outer diameter and tolerance of product | Measured value Average value | Measured value Standard deviation |
|---|---|---|---|---|
| Example 1 | columnar | 165.1 ± 2.0 | 165.30 | 0.181 |
| Example 2 | columnar | 190.5 ± 2.0 | 190.63 | 0.200 |
| Example 3 | columnar | 190.5 ± 2.0 | 190.61 | 0.205 |
| Example 4 | columnar | 190.5 ± 2.0 | 190.79 | 0.125 |
| Example 5 | columnar | 190.5 ± 2.0 | 190.50 | 0.119 |
| Example 6 | columnar | 241.3 ± 2.0 | 241.30 | 0.185 |
| Example 7 | columnar | 241.3 ± 2.0 | 241.17 | 0.169 |

TABLE 1-continued

| | Shape | Outer diameter and tolerance of product | Measured value Average value | Measured value Standard deviation |
|---|---|---|---|---|
| Example 8 | columnar | 241.3 ± 2.0 | 241.26 | 0.184 |
| Example 9 | columnar | 241.3 ± 2.0 | 241.52 | 0.175 |
| Example 10 | columnar | 266.7 ± 2.0 | 266.77 | 0.144 |
| Example 11 | columnar | 266.7 ± 2.0 | 266.77 | 0.145 |

Examples 12 to 15

In Examples 12 to 15, a followers/doctor blade system as shown in FIG. 5 was used, in which an angle between the doctor blade and a tangential line of a honeycomb structural body at a point facing the doctor blade was set at 45°.

In Examples 12 to 15, two kinds of columnar honeycomb structural bodies having (1) an elliptical sectional shape of a major axis: 248.1 mm and a minor axis: 146.4 mm and (2) an elliptical sectional shape of a major axis: 275.1 mm and a minor axis: 192.5 mm, respectively, were coated. The rib thickness and the cell density of each of the honeycomb structural body were 0.175 mm and 400 cells/inch$^2$. In each example (Examples 12 through 15), plural coated honeycomb structural bodies were produced, and the average outer diameter and the standard deviation were determined. Results are shown in Table 2. From the above results, it is seen that the final coated products could be obtained by using the coating apparatus of the present invention within their tolerance of the respectively specified outer diameters thereof, even if the honeycomb structural bodies had the elliptical sectional shapes.

TABLE 2

| | Shape | | Outer diameter and tolerance of product | Measured value Average value | Measured value Standard deviation |
|---|---|---|---|---|---|
| Example 12 | eliptical-section columnar | major axis | 248.1 ± 2.0 | 247.81 | 0.144 |
| | | minor axis | 146.4 ± 2.0 | 146.23 | 0.137 |
| Example 13 | eliptical-section columnar | major axis | 248.1 ± 2.0 | 247.85 | 0.154 |
| | | minor axis | 146.4 ± 2.0 | 146.19 | 0.194 |
| Example 14 | eliptical-section columnar | major axis | 275.1 ± 2.0 | 274.95 | 0.178 |
| | | minor axis | 192.5 ± 2.0 | 192.41 | 0.139 |
| Example 15 | eliptical-section columnar | major axis | 275.1 ± 2.0 | 274.87 | 0.147 |
| | | minor axis | 192.5 ± 2.0 | 192.31 | 0.176 |

Comparative Examples 1 to 11

Outer peripheral surfaces of honeycomb structural bodies were manually coated. In each of Comparative Examples 1 to 11, plural coated honeycomb structural bodies were produced, and the average outer diameter and the standard deviation were determined. Results are shown in Tables 3 and 4. The outer configurations of the honeycomb structural bodies were the same as those of the honeycomb structural bodies used in Examples 1 to 15.

TABLE 3

| | Shape | Outer diameter and tolerance of product | Measured value Average value | Standard deviation |
|---|---|---|---|---|
| Comparative Example 1 | columnar | 165.1 ± 2.0 | 165.57 | 0.452 |
| Comparative Example 2 | columnar | 190.5 ± 2.0 | 190.69 | 0.448 |
| Comparative Example 3 | columnar | 190.5 ± 2.0 | 190.70 | 0.437 |
| Comparative Example 4 | columnar | 190.5 ± 2.0 | 190.91 | 0.396 |
| Comparative Example 5 | columnar | 241.3 ± 2.0 | 241.09 | 0.418 |
| Comparative Example 6 | columnar | 241.3 ± 2.0 | 241.21 | 0.438 |
| Comparative Example 7 | columnar | 266.7 ± 2.0 | 266.95 | 0.375 |

TABLE 4

| | Shape | | Outer diameter and tolerance of product | Measured value Average value | Standard deviation |
|---|---|---|---|---|---|
| Comparative Example 8 | eliptical-section columnar | major axis | 248.1 ± 2.0 | 247.64 | 0.398 |
| | | minor axis | 146.4 ± 2.0 | 145.83 | 0.423 |
| Comparative Example 9 | eliptical-section columnar | major axis | 248.1 ± 2.0 | 247.73 | 0.358 |
| | | minor axis | 146.4 ± 2.0 | 145.62 | 0.425 |
| Comparative Example 10 | eliptical-section columnar | major axis | 275.1 ± 2.0 | 274.80 | 0.346 |
| | | minor axis | 192.5 ± 2.0 | 192.35 | 0.455 |
| Comparative Example 11 | eliptical-section columnar | major axis | 275.1 ± 2.0 | 274.87 | 0.468 |
| | | minor axis | 192.5 ± 2.0 | 192.11 | 0.460 |

What is claimed is:

1. Apparatus for coating an outer periphery of a columnar structural body, comprising:

(a) a holder for supporting a columnar structural body; (b) a coater for coating the outer periphery of the columnar structural body with a coating material; (c) a feeder for feeding the coating material to the coater; (d) a driving unit for rotating at least one of the columnar structural body and the coater relative to each other around an axis of the holder; and (e) a doctor blade directly opposed and spaced from the outer periphery of the columnar structural body by a given distance for directly and uniformly spreading a coating material applied around the outer periphery of the columnar structural body.

2. The coating apparatus set forth in claim 1, which further comprises a driving means for moving the doctor blade along the outer peripheral surface of the columnar structural body.

3. The coating apparatus set forth in claim 1, which further comprises an aligning mechanism for aligning a rotary axis of the columnar structural body supported by the holder with that of the holder.

4. The coating apparatus set forth in claim 1, which further comprises a transporter for feeding the columnar structural body to the holder from outside.

5. The coating apparatus set forth in claim 1, wherein said holder comprises first and second pallets at least one of which is movable in parallel to said axis of the holder, and the columnar structural body is to be sandwiched between the first and second pallets.

6. The coating apparatus set forth in claim 5, wherein said first and second pallets are vertically arranged and opposed to each other.

7. The coating apparatus set forth in claim 1, which further comprises a separator for keeping substantially constant the distance between the doctor blade and the outer periphery of the columnar structural body.

8. The coating apparatus set forth in claim 7, wherein said separator follows an outer periphery of at least one of the first and second pallets during the relative rotation of the columnar structural body and the coater.

9. The coating apparatus set forth in claim 7, wherein said separator comprises first and second follower rollers which are spaced from each other at a given distance and follow the outer periphery of at least one of the first and second pallets during the relative rotation of the columnar structural body and the coater.

10. The coating apparatus set forth in claim 1, wherein the doctor blade has an angle of 30°–90° relative to a tangential line of the columnar structural body at a point facing the radially inner end of the doctor blade.

11. The coating apparatus set forth in claim 5, further comprising first and second follower rollers are contacting with the outer peripheral surface of the second pallet while the follower rollers are spaced from each other by a given distance and outer peripheral surfaces thereof are in parallel to the longitudinal direction of the columnar structural body, the doctor blade forms a given angle relative to a segment connecting centers of the first and second follower rollers, and the doctor blade follows the outer peripheral surface of the first pallet while being moved to-and-fro relative to the outer peripheral surface of the first pallet.

12. The coating apparatus set forth in claim 5, further comprising third and fourth follower rollers contacting with the outer peripheral surface of the first pallet while the third and fourth follower rollers are spaced from each other by a given distance, the first follower roller is aligned with the third follower roller, and the second follower roller is aligned with the fourth follower roller.

13. The coating apparatus set forth in claim 1, wherein the doctor blade is made of a SUS stainless steel or a wear resistant ceramic material.

14. The coating apparatus set forth in claim 1, wherein the first pallet and/or the second pallet is made of made of a SUS stainless steel or a wear resistant ceramic material.

15. The coating apparatus set forth in claim 5, wherein a resilient sheet through which the coating material will not permeate is provided at each of the opposed surfaces of the first and second pallets.

* * * * *